US011454908B2

(12) United States Patent
Kozuma et al.

(10) Patent No.: US 11,454,908 B2
(45) Date of Patent: Sep. 27, 2022

(54) IMAGE HEATING APPARATUS COMPRISING HALOGEN HEATER WITH TWO GLASS-COVERED HEATING PORTIONS

(71) Applicant: Canon Kabushiki Kaisha, Tokyo (JP)

(72) Inventors: Takeshi Kozuma, Tokyo (JP); Youichi Chikugo, Chiba (JP); Hidekazu Tatezawa, Saitama (JP); Yutaro Tsuno, Tokyo (JP); Rikiya Takemasa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/323,356

(22) Filed: May 18, 2021

(65) Prior Publication Data

US 2021/0373470 A1 Dec. 2, 2021

(30) Foreign Application Priority Data

May 28, 2020 (JP) ..... JP2020-093136

(51) Int. Cl.
*G03G 15/20* (2006.01)

(52) U.S. Cl.
CPC ..... *G03G 15/2053* (2013.01); *G03G 15/2017* (2013.01); *G03G 15/2064* (2013.01)

(58) Field of Classification Search
CPC ..... G03G 15/2053; G03G 15/2017; G03G 15/2064; G03G 15/2007; H01K 1/24; H01K 9/08; H05B 3/0033; H05B 3/0066; H05B 3/06; H05B 3/444; H05B 2203/005
See application file for complete search history.

(56) References Cited

U.S. PATENT DOCUMENTS 6,442,360 B1 * 8/2002 Onodera ..... G03G 15/2053 219/216
2007/0110413 A1 * 5/2007 Konishi ..... H05B 3/009 392/407
2009/0190343 A1 * 7/2009 Shimonaka ..... H05B 3/0066 362/217.01
2017/0219971 A1 * 8/2017 Kamiya ..... G03G 15/2053

FOREIGN PATENT DOCUMENTS

JP 2015045273 A 4/2016
JP 2016133707 A * 7/2016

* cited by examiner

*Primary Examiner* — Arlene Heredia
(74) *Attorney, Agent, or Firm* — Venable LLP

(57) ABSTRACT

An image heating apparatus includes a heating roller, and, a heater unit. The heater unit is provided on an inner side of the heating roller. The heater unit includes a first halogen heater, a second halogen heater, and, a pair of holders. The pair of holders holds the first halogen heater and the second halogen heater such that the pair of holders, the first halogen heater and the second halogen heater are integrally inserted to and extracted from the heating roller.

11 Claims, 9 Drawing Sheets

IMAGE HEATING APPARATUS COMPRISING HALOGEN HEATER WITH TWO GLASS-COVERED HEATING PORTIONS

BACKGROUND OF THE INVENTION

Field of the Invention

The present invention relates to an image heating apparatus for heating a toner image home on a recording material.

Description of the Related Art

Hitherto, a configuration where a plurality of heaters is arranged on an inner side of a roller has been known as a fixing unit, which is one example of an image heating apparatus (refer, for example, to Japanese Patent Application Laid-Open Publication No. 2016-45273).

According to a configuration where a healer is provided on an inner side of a roller, an operation is required to insert the heater to and extract the heater from the roller in a rotational axis direction during assembly and maintenance of the apparatus. In this state, if there area plurality of heaters, especially if there are a plurality of terminals of the heaters, such operation is difficult to carry out. For example, during a process of inserting the heater to the inner side of the roller while holding a first end side of the heater, a second end side of the heater cannot be held until the second end is exposed from the roller at the other side.

In a case where there is only one heater, it is relatively easy to insert the heater to the roller by holding the first end side of the heater and controlling the position and posture of the second end side of the heater while preventing the heater from touching the inner side of the roller. In contrast, if there are multiple heaters and multiple terminals, the insertion operation becomes difficult since the heaters must be inserted with care while controlling the relative positions and postures of the heaters so that the heaters do not contact each other or the roller.

SUMMARY OF THE INVENTION

The present invention provides a configuration where a plurality of heaters is arranged on an inner side of a roller and a plurality of terminals of the heaters is also arranged, wherein the insertion of a plurality of heaters to the roller can be carried out easily.

According to one aspect of the present invention, an image heating apparatus configured to heat a toner image borne on a recording material at a nip portion. The image heating apparatus includes a heating roller configured to rotate, and, a heater unit provided on an inner side of the heating roller. The heater unit configured to be inserted to and extracted from the heating roller along a rotational axis direction of the heating roller. The heater unit includes a first halogen heater, a second halogen heater, and, a pair of holders. The first halogen heater includes a first heating portion, a first glass tube configured to cover the first heating portion, a second heating portion, a second glass tube configured to cover the second heating portion, and a pair of first supporting portions configured to support both end portions of the first glass tube and both end portions of the second glass tube. The second halogen heater includes a third heating portion, a third glass tube configured to cover the third heating portion, and a pair of second supporting portions configured to support both end portions of the third glass tube. The pair of holders are fitted each of the pair of first supporting portions and the pair of second supporting portions to the pair of holders. The pair of holders holds the first halogen heater and the second halogen heater such that the pair of holders, the first halogen heater and the second halogen heater are integrally inserted to and extracted from the heating roller.

Further features of the present invention will become apparent from the following description of exemplary embodiments with reference to the attached drawings.

DESCRIPTION OF THE EMBODIMENTS

Figure 1:
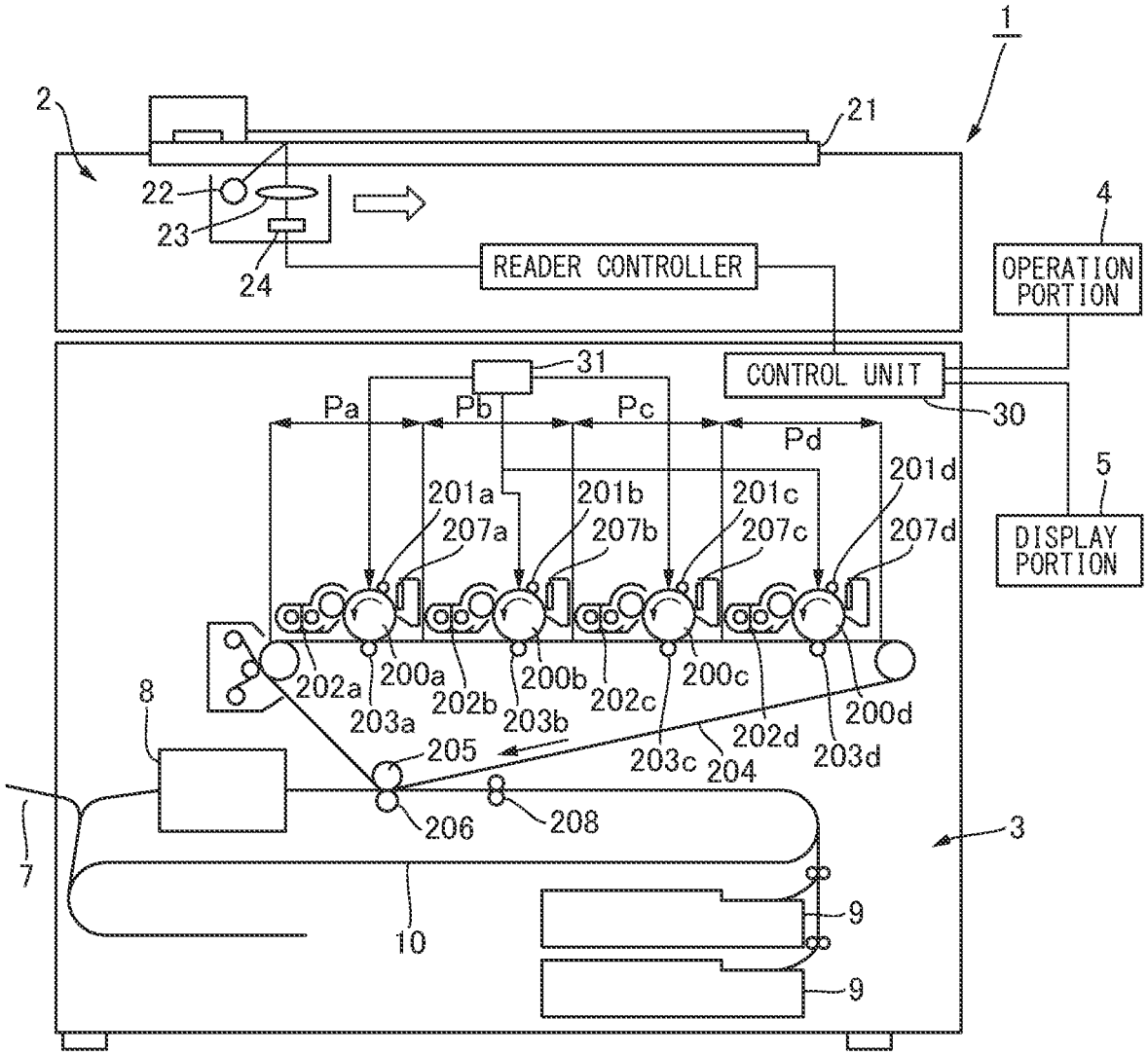
FIG. 1 is a cross-sectional view of a schematic configuration of an image forming apparatus according to an embodiment.

An embodiment will be described with reference to FIGS. 1 through 9. At first, a schematic configuration of an image forming apparatus according to the present embodiment will be described with reference to FIG. 1.

Image Forming Apparatus

An image forming apparatus 1 is a full-color printer adopting an electrophotographic system including four image forming units Pa, Pb, Pc and Pd that are provided in correspondence to four colors, which are yellow, magenta, cyan and black. In the present embodiment, a so-called tandem-type system is adopted in which the image forming wilts Pa, Pb, Pc and Pd are arranged along a rotational direction of an intermediate transfer belt 204 described later. The image forming apparatus 1 forms a toner image on a recording material in response to an image signal from an image reading unit, i.e., document reading apparatus, 2 connected to an image forming apparatus body 3 or from a host device such as a personal computer connected in a manner capable of communicating with the image forming apparatus body 3. The recording material can be various types of sheet materials, such as paper, plastic film, and cloth.

The image forming apparatus 1 includes the image reading unit 2 and the image forming apparatus body 3. The image reading unit 2 reads a document placed on a platen glass 21, where light emitted from a light source 22 is reflected on the document and forms an image on a CCD sensor 24 via an optical member 23 such as a lens. Such an optical unit scans the document in an arrow direction to convert the document into electric signal data array per line. The image signal obtained by the CCD sensor 24 is transmitted to the image forming apparatus body 3, where image processing corresponding to image forming units described later is performed in a control unit 30. Further, the control unit 30 also receives image signals as external input from an external host device such as a print server.

The image forming apparatus body 3 includes a plurality of image forming units Pa, Pb, Pc and Pd, and image is formed in each image forming unit based on the image signal described above. That is, the image signal is converted into a laser beam subjected to PWM (pulse width modulation control) by the control unit 30. A polygon scanner 31 serving as an exposing unit scans the laser beam according to the image signal. The laser beam is irradiated to photosensitive drums 200*a* to 200*d* which serve as image bearing members of the respective image forming units Pa to Pd.

Images of corresponding colors are formed in the image forming unit Pa for yellow (Y), the image forming unit Pb for magenta (M), the image forming unit Pc for cyan (C) and the image forming unit Pd for black (Bk). The image forming units Pa to Pd adopt a similar configuration, so that only the details of the image forming unit Pa for Y is described below and details of other image forming units are omitted. In the image forming unit Pa, a toner image is formed on a surface of a photosensitive drum 200*a* based on an image signal, as described hereafter.

A charging roller 201*a* serving as a primary charger charges a surface of the photosensitive drum 200*a* to a predetermined potential to prepare for the formation of an electrostatic latent image. An electrostatic latent image is formed on the surface of the photosensitive drum 200*a* charged to predetermined potential by a laser beam emitted from the polygon scanner 31. A developing unit 202*a* develops the electrostatic latent image formed on the photosensitive drum 200*a* and forms a toner image. A primary transfer roller 203*a* performs electric discharge from a rear side of the intermediate transfer belt 204 to apply a primary transfer bias having an opposite polarity as toner and transfers the toner image formed on the photosensitive drum 200*a* to the intermediate transfer belt 204. The surface of the photosensitive drum 200*a* after transfer is cleaned by a cleaner 207*a*.

The toner image on the intermediate transfer belt 204 is conveyed to subsequent image forming units, where toner images of respective colors of Y, M, C and Bk formed in the respective image forming units are transferred sequentially in the named order by which a four-color image is formed on the surface of the intermediate transfer belt 204. The toner image having passed through the Bk image forming unit Pd arranged most downstream in a rotating direction of the intermediate transfer belt 204 is conveyed to a secondary transfer portion composed of the secondary transfer roller pair 205 and 206. Then, a secondary transfer electric field having opposite polarity as the toner image formed on the intermediate transfer belt 204 is applied at the secondary transfer portion, by which the toner image is secondarily transferred to the recording material.

The recording material is stored in a cassette 9, and the recording material fed from the cassette 9 is conveyed to a registration portion 208 composed of a pair of registration rollers, where the recording material stands by at the registration portion 208. Thereafter, the registration portion 208 is subjected to timing control so that the position of the paper matches the timing of the toner image on the intermediate transfer belt 204 when the recording material is conveyed to the secondary transfer portion.

The recording material to which the toner image has been transferred at the secondary transfer portion is conveyed to a fixing unit 8 and subjected to heat and pressure at the fixing unit 8, by which the toner image borne on the recording material is fixed to the recording material. The recording material having passed through the fixing unit 8 is discharged to a sheet discharge tray 7. When images are to be formed on both sides of the recording material, after transferring and fixing the toner image to a first surface, i.e., front surface, of the recording material, the recording material is passed through a reverse conveyance portion 10 where front and rear sides of the recording material are reversed, and a toner image is transferred and fixed to a second surface, i.e., rear surface, of the recording material, before the recording material is placed on the sheet discharge tray 7.

The control unit 30 performs control of the whole image forming apparatus 1, as described above. Further, various settings of the control unit 30 can be entered through an operation portion 4 or a display portion 5 of the image forming apparatus 1. The operation portion 4 and the display portion 5 can be a touch panel and buttons provided on the image forming apparatus 1 that can be operated manually, for example.

Such control unit 30 includes a CPU (Central Processing Unit), a ROM (Read Only Memory), and a RAM (Random Access Memory). The CPU reads programs that correspond to the control procedure stored in the ROM and performs control of respective units. Further, work data and input data are stored in the RAM, and the CPU carries out control based on the aforementioned programs and referring to data stored in the RAM.

Fixing Unit

Figure 2:
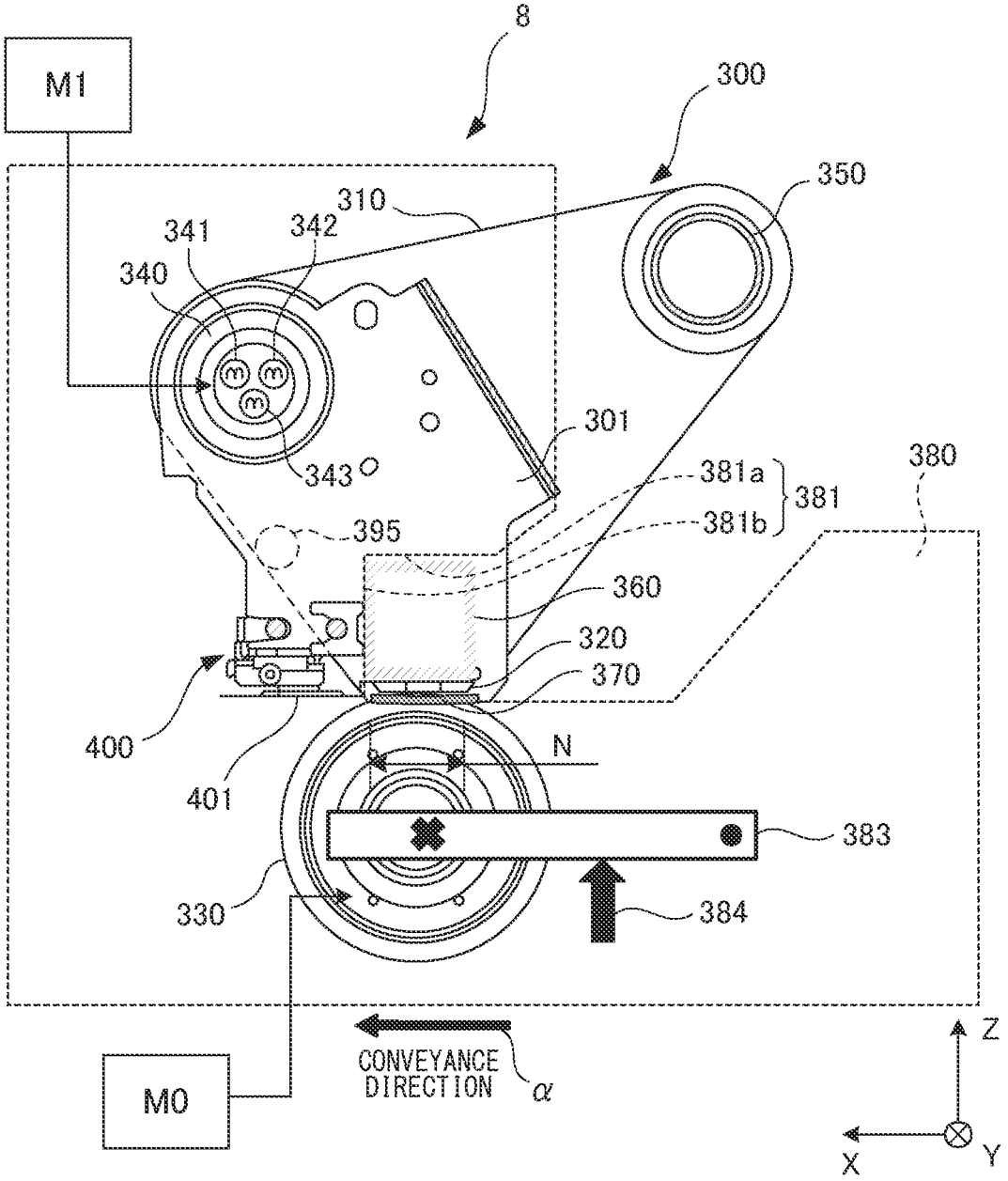
FIG. 2 is a cross-sectional view of a schematic configuration of a fixing unit according to the embodiment.

Next, a configuration of the fixing unit 8 serving as an image heating apparatus according to the present embodiment will be described with reference to FIG. 2. The present embodiment adopts a belt heating-type fixing unit using an endless belt. In FIG. 2, the recording material is conveyed from right to left, as illustrated by arrow α. The fixing unit 8 includes a heating unit 300 having a fixing belt 310 that serves as an endless rotatable belt member, and a pressing roller 330 serving as a pressure rotating body that contacts the fixing belt 310 and forms a nip portion N together with the fixing belt 310.

The heating unit 300 includes the above-mentioned fixing belt 310, a fixing pad 320 serving as a nip portion forming member and a pad member, and a heating roller 340 and a stretching roller 350 serving as a stretching member. The pressing roller 330 serving as a driving rotator also serves as a driving roller that abuts against an outer circumferential surface of the fixing belt 310 and rotates to thereby apply driving force to the fixing belt 310.

The fixing belt 310, which is an endless belt, has thermal conductivity and heat resisting property, and is formed to have a thin cylindrical shape with an inner diameter of 120 mm, for example. In the present embodiment, the fixing belt 310 adopts a three-layer structure including a base layer, an elastic layer formed on an outer circumference of the base layer, and a release layer formed on an outer circumference of the elastic layer. The base layer is made of polyimide resin (PI) and has a thickness of 60 μm, the elastic layer is made of silicone rubber and has a thickness of 300 μm, and the release layer is made of PFA (tetrafluoro-ethylene-perfluoro alkoxy ethylene copolymer resin) as fluororesin and has a thickness of 30 μm. This fixing belt 310 is stretched across the fixing pad 320, the heating roller 340 and the stretching roller 350.

The fixing pad 320 serving as a nip portion forming member is arranged on an inner side of the fixing belt 310 and opposed to the pressing roller 330 with the fixing belt 310 interposed therebetween, forming, the nip portion N for nipping and conveying the recording material between the fixing belt 310 and the pressing roller 330. In the present embodiment, the fixing pad 320 is an approximately plate-shaped member having a long length in a width direction, which is a longitudinal direction intersecting a direction of rotation of the fixing belt 310, or a rotational axis direction of the heating roller 340. The nip portion N is formed by the fixing pad 320 being pressed against the pressing roller 330 and nipping the fixing belt 310. The material of the fixing pad 320 is LCP (liquid crystal polymer).

At least a portion of the fixing pad 320 forming the nip portion N has a planar shape. That is, the portion of the fixing pad 320 that contacts an inner circumferential surface of the fixing, belt 310 through a lubricating sheet 370 described later is formed in an approximately planar shape, and therefore, the shape of the nip portion is approximately flat. According to such configuration, especially when fixing a toner image on an envelope serving as the recording material, it becomes possible to suppress occurrence of wrinkles and image deviation on the envelope.

The fixing pad 320 is supported by a stay 360 serving as a support member arranged on the inner side of the fixing belt 310. That is, the stay 360 is arranged on an opposite side from the pressing roller 330 with respect to the fixing pad 320, and support is the fixing pad 320. The stay 360 is a reinforcement member having rigidness and a long length along the longitudinal direction of the fixing belt 310, which contacts the fixing pad 320 and reinforces the fixing pad 320 from the hack. That is, in a state Where the fixing pad 320 is pressed by the pressing roller 330, the stay 360 provides sufficient strength to the fixing pad 320 to ensure pressure to be applied at the nip portion N.

The stay 360 is made of metal such as stainless steel, and has an approximately rectangular cross section, i.e., transverse section, orthogonal to the longitudinal direction of the stay 360 intersecting with the direction of rotation of the fixing belt 310. For example, the stay 360 is formed of a drawing material made of SUS 304 (stainless steel) having a thickness of 3 mm, whose strength is ensured by molding the material to have an approximately hollow square cross-sectional shape. The stay 360 can also have an approximately rectangular cross-section formed by combining and welding together a plurality of metal plates. If the strength can be ensured, the material of the stay 360 is not limited to stainless steel.

The lubricating sheet 370 is interposed between the fixing pad 320 and the fixing belt 310. In the present embodiment, a PI (polyimide) sheet coated with PTFE (polytetrafluoroethylene) and having a thickness of 100 μm is used as the lubricating sheet 370. The PI sheet has 100-μm projections formed at 1-mm intervals, and sliding friction thereof is reduced by reducing the contact area with the fixing belt 310.

Lubricant for improving slidability is applied in advance to a surface of the lubricating sheet 370 that is in contact with the fixing belt 310. In the present embodiment, oil is used as lubricant. Silicone oil is suitably used as lubricant from the viewpoint of heat resisting property, and silicone oil having various viscosities are used according to conditions of use. Excessive viscosity deteriorates fluidity of the lubricant during application, so a viscosity of 30,000 cSt or less is normally used. Actual examples of such oil include dimethylsilicone oil, amino-modified silicone oil and fluorine denatured silicone oil, but the oil is not limited to these examples.

The present embodiment also includes a lubricant application roll 395 serving as a lubricant applying member that applies lubricant to an inner circumferential surface of the fixing belt 310. Lubricant is thereby applied to the inner circumferential surface of the fixing belt 310. The lubricant application roll 395 is arranged between the fixing pad 320 and the heating roller 340 and abuts against the inner side of the fixing belt 310. The lubricant application roll 395 is formed of a shaft and a lubricant retaining layer. The shaft can be made, for example, of aluminum, iron, stainless steel, or brass. The lubricant retaining layer is a layer that can be impregnated with and retain the lubricant to be applied, and the lubricant impregnated in the lubricant retaining layer is oozed out and applied to the inner surface of the fixing belt 310. Porous material and fiber material can be used as the material of the lubricant retaining layer.

As illustrated in FIG. 2, the heating roller 340 is arranged on the inner side of the fixing belt 310, stretching the fixing belt 310 together with the fixing pad 320 and the stretching roller 350. As described above, lubricant is applied on the inner circumferential surface of the fixing belt 310, so that the fixing belt 310 is stretched by the heating roller 340 with the lubricant applied therebetween. The heating roller 340 is arranged downstream of the fixing pad 320 and upstream of the stretching roller 350 in the direction of rotation of the fixing belt 310. Thereby, the fixing belt 310 having passed through the nip portion N is directly drawn by the driving force of the heating roller 340 without having a stretching roller interposed therebetween.

The heating roller 340 is made of metal such as aluminum and stainless steel, and formed in a cylindrical shape, and a plurality of halogen heaters 341, 342 and 343 serving as a plurality of heaters for heating the fixing belt 310 are arranged on the inner side thereof. The heating roller 340 is heated to a predetermined temperature by the halogen heaters 341, 342 and 341.

In the present embodiment, the heating roller 340 is formed of a stainless-steel pipe having a thickness of 1 mm, and on the inner side of the heating roller 340 are arranged three halogen heaters 341 to 343. It is preferable to have a plurality of halogen heaters from the viewpoint of temperature distribution control in the longitudinal direction, that is, rotational axis direction, of the heating roller 340, and in the present embodiment, there are three halogen heaters, but the number can be two, four or more. The multiple halogen heaters 341 to 343 have mutually different light distributions in the longitudinal direction, and lighting ratios thereof are controlled according to the size of the recording material. The heater is not limited to a halogen heater, and other types of heaters, such as a carbon heater, capable of heating the heating roller 340 can be used. The fixing belt 310 is heated by the heating roller 340 which is heated by the halogen heaters 341 to 343 and controlled to a predetermined target temperature according to the type of recording material being used based on temperature detected by a thermistor not shown.

A gear is fixed to one end portion in the rotational axis direction of the heating roller 340 supported rotatable on a frame 301 serving as a heating roller supporting portion, and the heating roller 340 is driven to rotate through the gear by being connected to a motor M1 serving as an auxiliary driving roller drive source. Driving force is applied to the fixing belt 310 by the rotation of the heating roller 340. The force applied from the heating roller 340 to the fixing belt 310 is referred to as an auxiliary driving force. The heating roller 340 can also be driven to rotate by being connected to a motor M0 serving as a pressing roller drive source mentioned later. Further, a drive transmission mechanism from the motor can be a mechanism other than a gear, such as a mechanism adopting a pulley and a belt or a mechanism in which a roller driven by a motor is abutted from the exterior. In any case, according to the present embodiment, a peripheral speed of the heating roller 340 is set faster than a peripheral speed of the pressing roller 330.

The stretching roller 350 is arranged on an inner side of the fixing belt 310 to stretch the fixing belt 310 together with the fixing pad 320 and the heating roller 340 and is driven to rotate by following the rotation of the fixing belt 310. In the present embodiment, the stretching roller 350 is urged by a spring supported on a frame of the heating unit 300 and serves as a tension roller that applies predetermined tension to the fixing belt 310. The tension applied by the spring according to the present embodiment is 50 N. As described, by applying tension to the fixing belt 310 by the stretching roller 350, the fixing belt 310 is moved to rotate along the fixing pad 320.

The stretching roller 350 is made of metal such as aluminum or stainless steel, and formed in a cylindrical shape. According to the present embodiment, the stretching roller 350 is a stainless-steel or aluminum pipe having an outer diameter of 40 mm and a thickness of 1 mm, the end portions thereof being rotatably supported by a bearing not shown. The stretching roller 350 can be a stretching roller on which the fixing belt 310 is simply stretched, or it can be a roller having a steering function in addition to the tension-applying function. The steering function refers to a function of controlling the position, i.e., shift position, of the fixing belt 310 with respect to the rotational axis direction, i.e., longitudinal direction, of the heating roller 340 by tilting the stretching roller 350 from the rotational axis direction, for example.

The pressing roller 330 serving as the driving roller abuts against the outer circumferential surface of the fixing belt 310 and rotates, thereby applying driving force to the fixing belt 310. In the present embodiment, the pressing roller 330 is a roller having an elastic layer formed on an outer circumference of a shaft and a releasing layer formed on an outer circumference of the elastic layer. The shaft is made of stainless steel, the elastic layer is made of conductive silicone rubber having a thickness of 5 mm, and the releasing layer is made of PFA (tetrafluoro-ethylene-perfluoro alkoxy ethylene copolymer resin) as fluororesin and has a thickness of 50 μm. The pressing roller 330 is supported rotatably by a fixing frame 380 of the fixing unit 8, a gear being fixed to one end portion thereof, and the pressing roller 330 is connected to the motor M0 serving as the pressing roller drive source and driven to rotate through the gear.

The fixing frame 380 includes a heating unit positioning portion 381, a pressing frame 383 and a pressurizing spring 384. The heating unit 300 is positioned on the fixing frame 380 by having the stay 360 inserted to the heating unit positioning portion 381 and the stay 360 being fixed to the healing unit positioning portion 381 by a fixing unit not shown. The heating unit positioning portion 381 includes a pressure direction regulating surface 381*a* opposed to the pressing roller 330 and a conveyance direction regulating surface 381*b* which is an abutting surface of the heating unit 300 in an inserting direction. The stay 360 is fixed in a state where movement is regulated by the pressure direction regulating surface 381*a* and the conveyance direction regulating surface 381*b*. In this state, the pressing roller 330 is separated from the fixing belt 310.

After the heating unit 300 has been positioned on the heating unit positioning portion 381, the pressing roller 330 abuts against the fixing belt 310 by the pressing frame 383 being moved by a drive source and a cam not shown. Then, the pressing roller 330 is pressed against the fixing pad 320 via the fixing belt 310. According to the present embodiment, the pressing roller 330 also serves as a pressing member that is pressed against the fixing belt 310. According to the present embodiment, a pressing force during the image forming process is 1000 N.

According further to the present embodiment, a separation device 400 including a separation member, which according to the present embodiment is a separation plate, 401 that separates the recording material from the fixing belt 310 is arranged downstream of the nip portion N in the conveyance direction of the recording material. The separation member 401 is arranged with a gap from the outer circumferential surface of the fixing belt 310 and separates the recording material having passed the nip portion N from the fixing belt. Specifically, the separation member 401 is arranged close to a portion of the outer circumferential surface of the fixing belt 310 stretched between the fixing pad 320 and the heating roller 340. Further, the separation member 401 is formed in a blade shape, with a tip thereof opposed to the outer circumferential surface of the fixing belt 310. Further, the separation member 401 has a fluorine-based tape adhered to a metal plate to prevent adhesion of toner or damaging of image on the recording material by the sliding movement. In the present embodiment, the position of the separation member 401 with respect to the stay 360 in the conveyance direction of the recording material, that is, short direction of the stay 360, or direction X, is determined so that a gap is formed between the separation member 401 and the outer circumferential surface of the fixing, belt 310.

The fixing unit 8 configured as above nips and conveys a recording material P bearing a toner image and heating the toner image at the nip portion N formed between the fixing belt 310 and the pressing roller 330. Thereby, the toner image is melted and fixed to the recording material. According to the present embodiment, during the image forming process, a peripheral speed of the fixing belt 310 is set to 300 nm's, a pressing force applied at the nip portion N is set to 1000 N, and a temperature of the fixing belt 310 is set to 180° C.

Halogen Heater

Figure 3A:
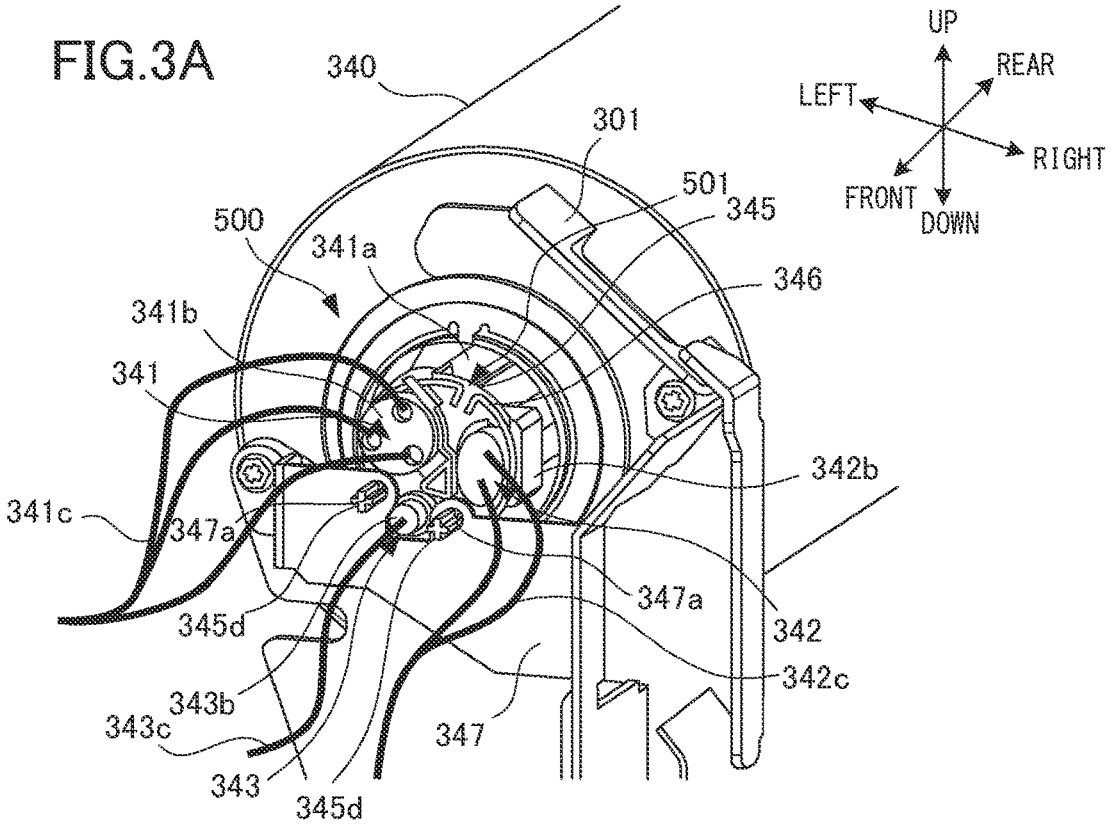
FIG. 3A is a perspective view in which a heating roller having a halogen heater arranged according to the embodiment is viewed from a first end side.
Figure 3B:
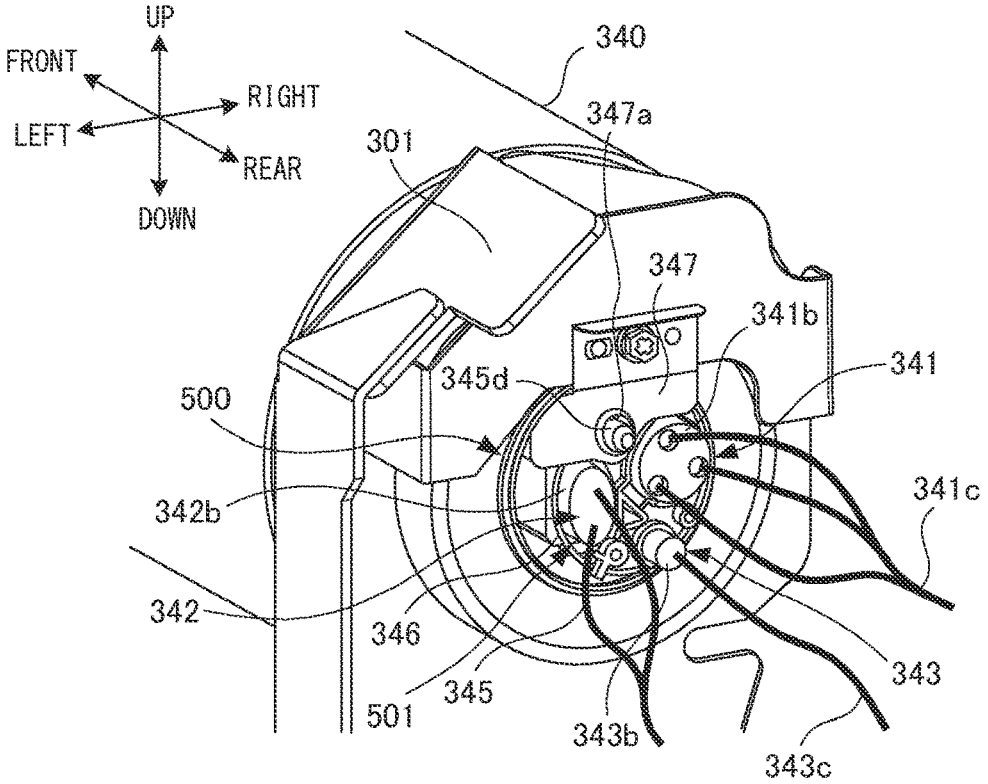
FIG. 3B is a perspective view in which the heating roller having the halogen heater arranged according to the embodiment is viewed from a second end side.

Next, a configuration of the halogen heaters 341, 342 and 343 arranged in the heating roller 340 will be described. FIGS. 3A and 3B are schematic views illustrating a vicinity of the halogen heaters 341, 342 and 343 and the heating roller 340. FIG. 3A is a perspective view illustrating a vicinity of a front-end portion of the fixing unit 8, and FIG. 3B is a perspective view illustrating a vicinity of a rear end portion of the fixing unit 8. A front side of the fixing unit 8 refers to a front side of the image forming apparatus 1 where an operator such as a user operates the apparatus. A rear side of the fixing unit 8 refers to a rear side of the image forming apparatus 1. The front-rear direction of the fixing unit 8 is the same direction as the rotational axis direction of the heating roller 340, and a heater unit 500 can be inserted to and extracted from an inner side of the heating roller 340 at least from one side, such as the rear side, of the heating roller 340 in the rotational axis direction.

The halogen heater 341 includes three glass tubes 341*a* each having a filament serving as a heating element (heating portion) passed through an inner side thereof, a pair of bases 341*b* serving as a pair of supporting portions that are connected to both end portions of the glass tubes 341*a*, and lead wires 341*c* each connected to the base 341*b* for supplying power. Each glass tube 341*a* covers the filament. The pair of bases 341*b* supports both end portions of the three glass tubes 341*a*. According to the present embodiment, a combination of heaters having one supporting portion, i.e., terminal, on each end thereof is referred to as one halogen heater. That is, even if there are a plurality of heating portions and glass tubes, if one terminal is provided on either end, the set of heating portions and glass tubes is referred to as one halogen heater. The terminal of the lead wires 341*c* is connected to a power supply of the image forming apparatus body, and the heating element is turned on when power is supplied to heat the surface of the heating roller 340 to a predetermined temperature.

The other halogen heaters 342 and 343 adopt a similar configuration except for the number of glass tubes and the light distribution of the heating elements. That is, the halogen heater 342 includes two glass tubes 342*a* (refer for examples to FIGS. 5 and 7 described later), bases 342*b* and lead wires 342*c*. Further, the halogen heater 343 includes one glass tube 343*a* (refer for example to FIGS. 5 and 7 described later), bases 343*b* and lead wires 343*c*.

Figure 4:
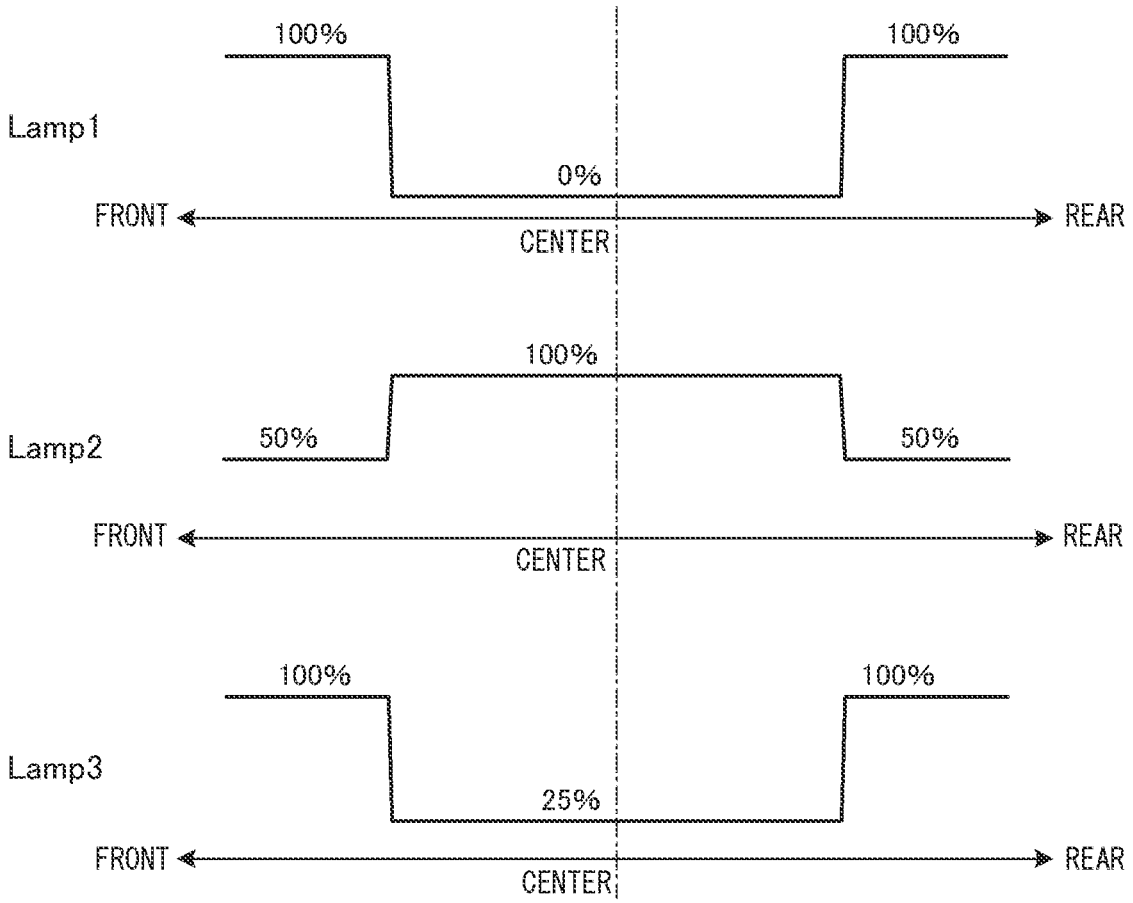
FIG. 4 is a view illustrating a light distribution of the halogen eater according to the embodiment.

The light distribution of the three glass tubes 341*a* of the halogen heater 341 according to the present embodiment is illustrated in FIG. 4. A horizontal axis shows a position in a front-rear direction, i.e., rotational axis direction of the heating roller 340, and a vertical axis shows a heat-generating performance of the glass tubes at that position. As can be seen from FIG. 4, the three glass tubes in the halogen heater 341 have mutually different light distributions. That is, there is a glass tube (Lamp 2) that mainly heats a center area in the rotational axis direction and there are glass tubes (Lamp 1 and Lamp 3) that mainly heat end portions in the rotational axis direction. In the present embodiment, the halogen heater 341 includes Lamp 1, Lamp 2 and Lamp 3, and the halogen heater 342 includes Lamp 1 and Lamp 2. The halogen heater 343 can be Lamp 3 or a heater having a flat light distribution in the longitudinal direction.

Thereby, a control corresponding to the size of the recording material in the width direction, i.e. rotational axis direction, becomes possible. For example, if a plurality of recording materials having a small width in the front-rear direction, such as paper sheets, is passed successively through the nip portion N, both end portions of the heating roller 340 in the rotational axis direction do not contact the recording material, so that the temperature tends to be increased easily compared to the center portion that is in contact with the recording material. Therefore, in that case, accumulation of heat at both end portions of the heating roller 340 in the rotational axis direction can be suppressed by reducing the light ratio of the glass tubes Lamp 1 and Lamp 3) that mainly heat the end portions. The halogen heaters 342 and 343 similarly have glass tubes with independent light distributions. However, the present invention is not limited to this example, and any configuration can be adopted where a plurality of halogen heaters is provided.

Healer Unit

The halogen heaters 341 to 343 mentioned above can be inserted to and extracted from the heating roller 340 during assembly or maintenance of the apparatus. Specifically, there are a plurality of halogen heaters according to the present embodiment, so that a configuration for holding a plurality of halogen heaters integrally is adopted, and this configuration, which is referred to as a heater unit 500, can be inserted to and extracted from the heating roller 340. In the following description, the heater unit 500 and a configuration for supporting the heater unit 500 will be described with reference to FIGS. 3A, 3B, 5 through 9.

Figure 5:
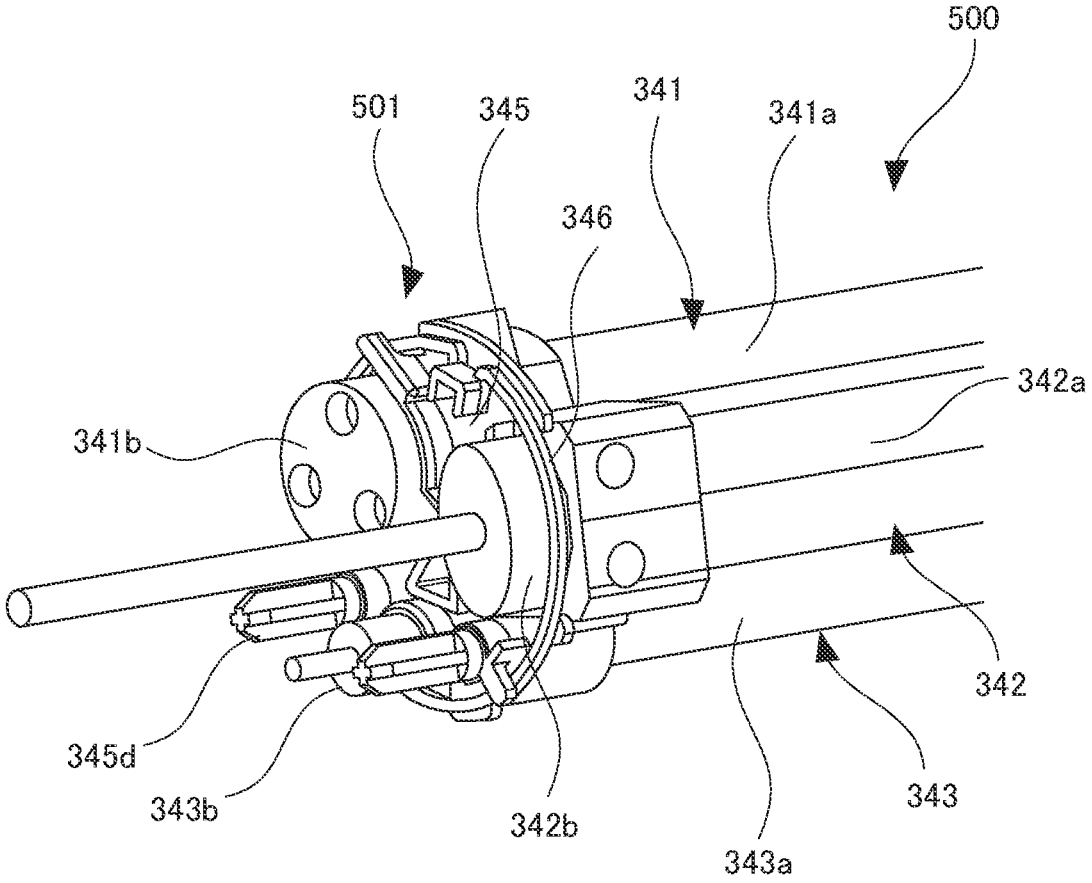
FIG. 5 is a perspective view of the first end side of the plurality of halogen heaters held by a holding portion according to the embodiment.

As illustrated in FIGS. 3A, 3B, 7, 8A and 8B, the heater unit 500 is supported at both sides, that is, front and rear sides, of the heating roller 340 in the rotational axis direction by support plates 347 serving as a pair of support members. Further, as illustrated in FIG. 5, the heater unit 500 includes three halogen heaters 341 to 343 serving as a plurality of heaters, and a pair of holding portions 501. As described earlier, the halogen heaters 341 to 343 are each arranged on the inner side of the heating roller 340 along the rotational axis direction. The pair of holding portions 501 respectively integrally hold both end portions of the three halogen heaters 341 to 343 in the rotational axis direction, and each holding portion 501 is supported by each of the pair of support plates 347.

The pair of holding portions 501 respectively include a holder 345 made of resin and serving as a positioning member, and a spring 346 serving as an urging member and annular retaining ring. The holder 345 is a member for positioning the three halogen heaters 341 to 343 in the circumferential direction of the heating roller 340. The spring 346 is a member that urges the halogen heaters 341 to 343 toward the holder 345 so that the three halogen heaters 341 to 343 positioned on the holders 345 are not separated, and the spring clamps the bases 341*b*, 342*b* and 343*b* from the outer side. In other words, the bases 341*b*, 342*b* and 343*b* at both front and rear end portions of the three halogen heaters 341 to 343 are bound and fixed at both the front and rear sides by the pair of holders 345 and the pair of springs 346 so that their mutual positions are not varied. This arrangement will be described in detail below.

Figure 7:
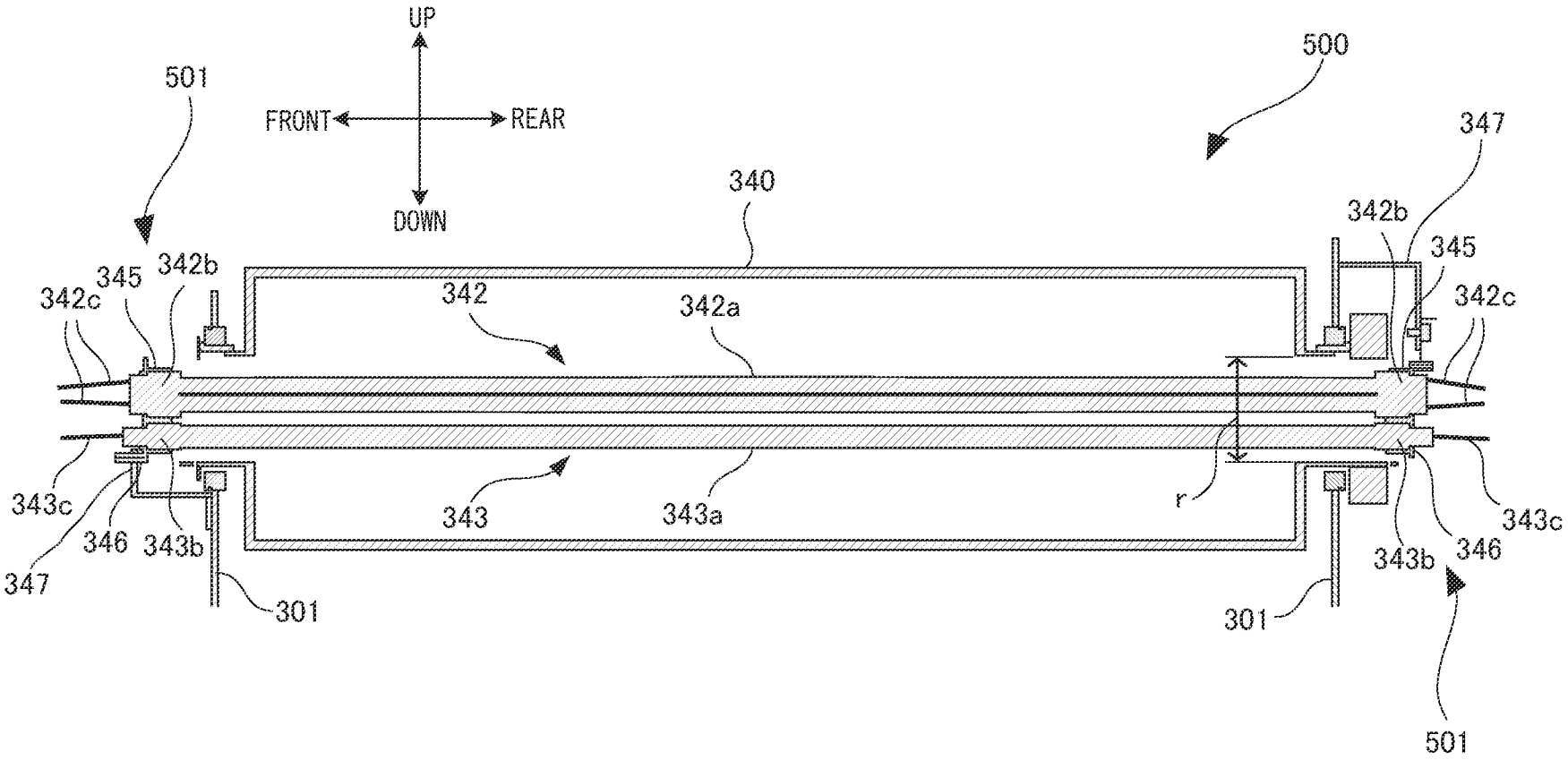
FIG. 7 is a cross-sectional view of the heating roller in which the halogen heaters are arranged according to the embodiment.
Figure 8A:
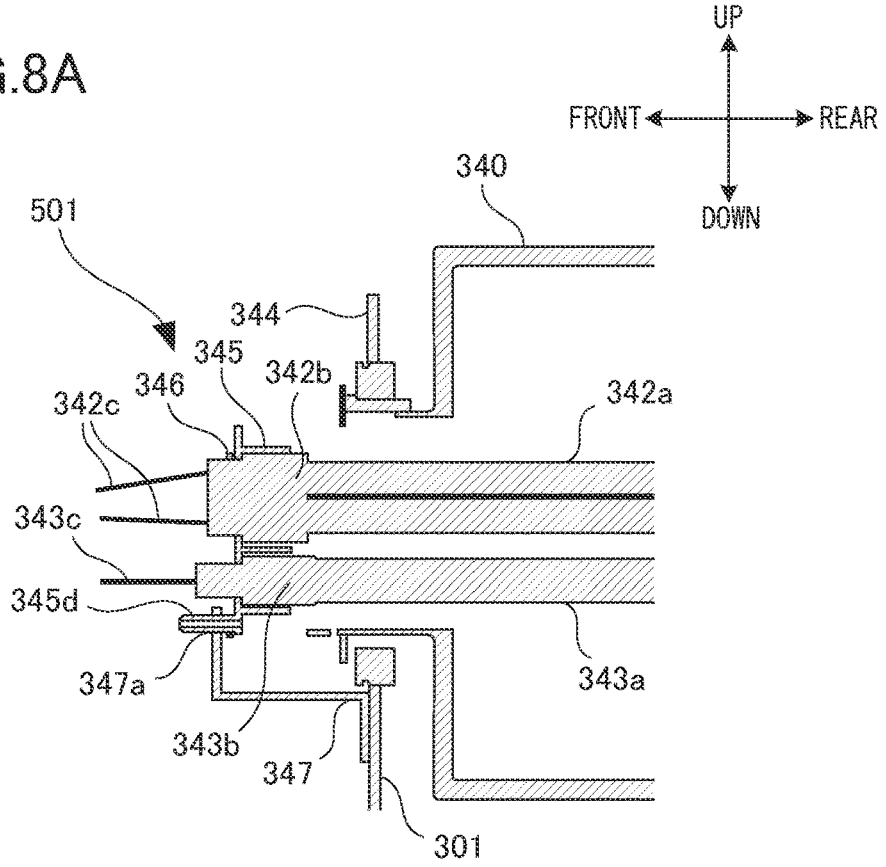
FIG. 8A is an enlarged view of a left side portion of FIG. 7.
Figure 8B:
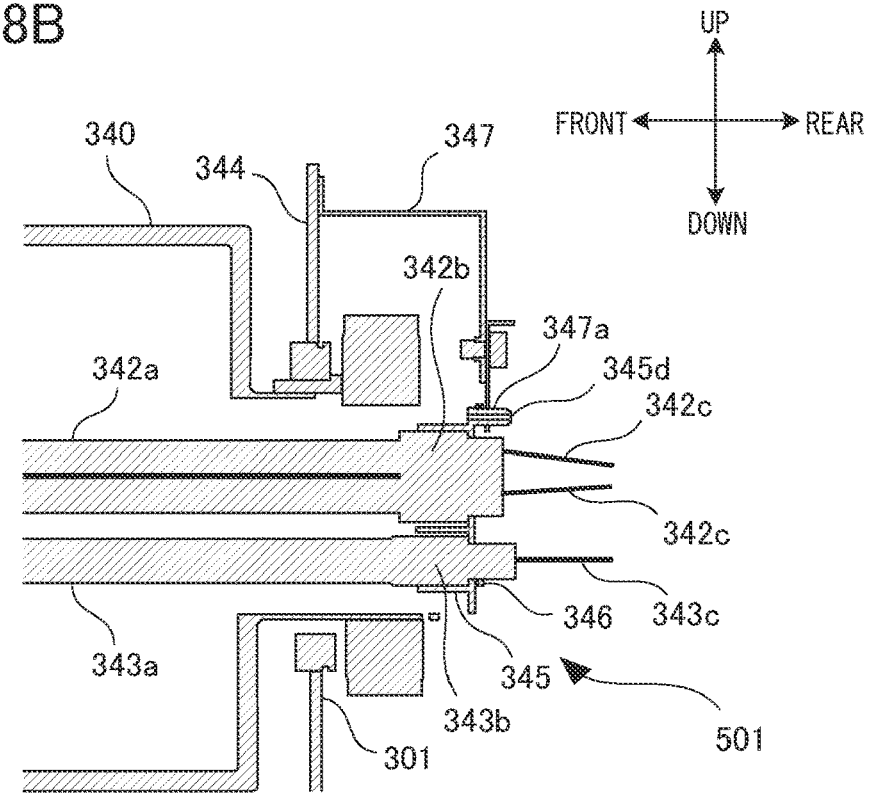
FIG. 8B is an enlarged view of a right side portion of FIG. 7.

FIG. 7 is a schematic view illustrating a cross section of the heating roller 340 of a plane parallel to the rotational axis and taken along the rotational axis of the heating roller 340. FIG. 7 only illustrates the halogen heaters 342 and 343 for simplification, but the halogen heater 341 also adopts the same support configuration. FIG. 8A is an enlarged front view of FIG. 7, and FIG. 8B is an enlarged rear view of FIG. 7.

Figure 6:
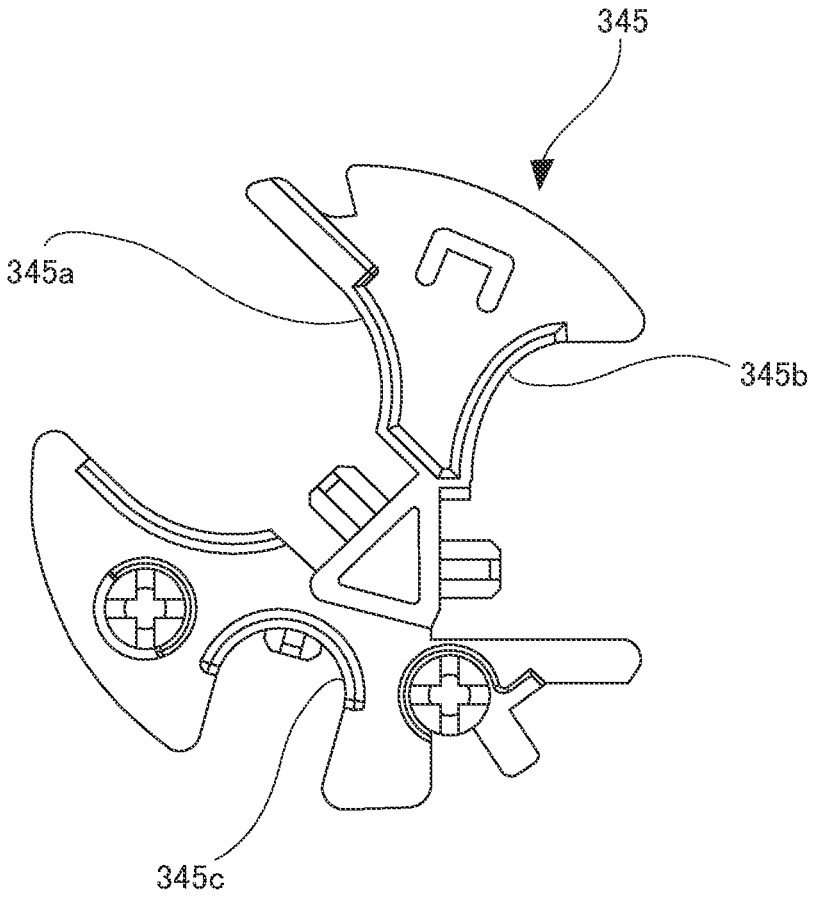
FIG. 6 is a plan view of a holder according to the embodiment.

FIG. 6 is a view illustrating the holder 345 from the rotational axis direction of the heating roller 340. As illustrated in FIG. 6, the holder 345 includes engagement recess portions 345*a*, 345*b* and 345*c* for respectively supporting the halogen heaters 341 to 343 in a circumferential direction. The engagement recess portions 345*a*, 345*b* and 345*c* are each formed to receive the end portions of the halogen heaters 341 to 343 and are designed to be loosely engaged with the outer circumferential surface of the end portions. That is, the engagement recess portion 345*a* is formed to allow the base 341*b* of the halogen heater 341 to be loosely fit thereto, the engagement recess portion 345*b* is formed to allow the base 342*b* of the halogen heater 342 to be loosely fit thereto, and the engagement recess portion 345*c* is formed to allow the base 343*b* of the halogen heater 343 to be loosely fit thereto (refer to FIG. 5). In other words, the holder 345 is fit to each of the bases 341*b*, 342*b* and 343*b*, and the holder holds the halogen heaters 341, 342 and 343 to be inserted to and extracted from the heating roller 340 integrally with the halogen heaters 341, 342 and 343.

Figure 9:
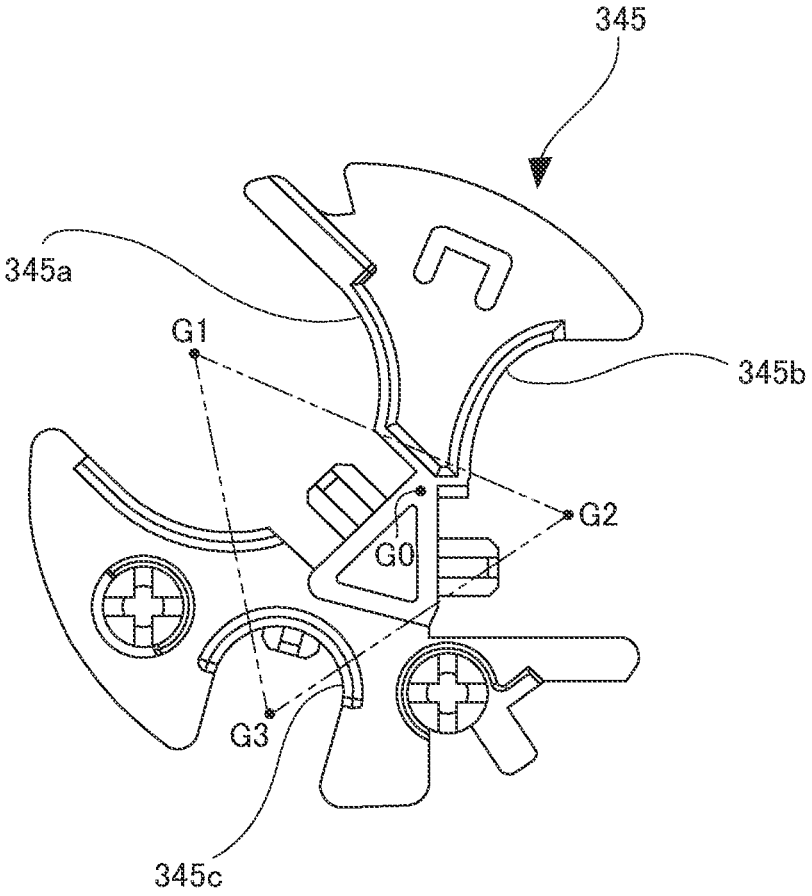
FIG. 9 is a view illustrating the holder from a rotational axis direction of the heating roller.

In the present embodiment, the heating roller 340 has a through hole through which the heater unit 500 is inserted and extracted, and the through hole has an inner diameter that is greater than an outer diameter of the holder 345, To allow the holder 345 to be inserted to and extracted from heating roller 340 through the through hole, the outer diameter of the holder 345 is limited. To arrange a plurality of halogen heaters, and for saying space, the present embodiment has divided the plurality of halogen heaters into a halogen heater including three glass tubes, a halogen heater including two glass tubes and a halogen heater including one glass tube. According to this configuration, the space of the holder can be saved compared to an arrangement where two sets of heaters each including three glass tubes are provided. FIG. 9 is a view of the holder 345 taken from the rotational axis direction of the heating roller 340. In FIG. 9, when the holder 345 is viewed in the rotational axis direction of the heating roller 340, a center of gravity G0 of the holder in the plan view, that is, projection plane of the holder, is positioned on an inner side of a line having connected centers of gravity of the halogen heaters (G1, G2 and G3), the shape of which is a triangle according to the present embodiment. According to this configuration, the stability of the operation for taking out the halogen heater unit during extraction from the heating roller 340 and insertion thereto can be improved.

Thereby, both ends of the halogen heaters 341 to 343 will be held loosely by a pair of holders 345. In this state, portions of the bases 341*b* through 343*b* are protruded further toward the end than the area held by the holder 345. The halogen heaters 341 to 343 are fixed by having the aforementioned portions bundled by the ring-shaped spring 346 from the outer side so that the bases 341*b* to 343*b* and the holder 345 are integrated.

That is, both ends of the halogen heaters 341 to 343 that are held loosely by the pair of holders 345 are held in an elastically bundled manner by the pair of springs 346, Each spring 346 is a ring-like elastic member having one part thereof cut out and arranged so that the bases 341*b* to 343*b* of the halogen heaters 341 to 343 held by the holder 345 are contained in the inner side thereof. By the diameter of the spring 346 shrinking elastically, the bases 341*b* to 343*b* are respectively pressed against the engagement recess portions 345*a*, 345*b* and 345*c* of the holder 345, and the halogen heaters 341 to 343 are held integrally. As a result, the heater unit 500 in which the halogen heaters 341 to 343, the pair of holders 345 and the pair of springs 346 are formed integrally as a unit is composed. The configuration for holding the plurality of halogen heaters is not limited thereto, and for example, the halogen heaters can be held using only the holders by elastically deforming and receiving the halogen heaters only by the holders.

As described earlier, the heater unit 500 can be inserted to and extracted from at least one side of the heating roller 340 in the rotational axis direction. In the present embodiment, the diameter of a circumscribed circle of the pair of holding portions 501 is set smaller than a minimum inner diameter r (FIG. 7) of the heating roller 340. Thereby, the heater unit 500 can be inserted to and extracted from the inner side of the heating roller 340. It is also possible to set the outer diameter of one holding portion 501 of the pair of holding portions 501 to be smaller than the minimum inner diameter r of the healing roller 340 and the outer diameter of the other holding portion 501 to be greater than the minimum inner diameter r. In this case, the heater unit 500 can be inserted to the heating roller 340 from one of the holding portions 501.

In any case, the support plates 347 serving as a pair of support members are provided on the front and rear sides of the heating roller 340 to fix the heater unit 500 inserted to the heating roller 340 to the frame 301 supporting the heating roller 340. The pair of support plates 347 is fixed to the frame 301 by fixing members such as screws, as illustrated in FIGS. 3A, 3B, 7, 8A and 8B. The frame 301 is arranged on both sides of the heating roller 340 in the rotational axis direction and rotatably supports both end portions of the heating roller 340. A pair of support plates 347 is formed to protrude outward from the portion of the frame 301 supporting the heating roller 340 in the rotational axis direction, that is, direction separating from the heating roller 340. Then, the holding portions 501 of the heater unit 500 are respectively supported by the support plates 347.

That is, the holding portions 501 on bath end portions are protruded from the heating roller 340 in a state where the heater unit 500 is arranged in the heating roller 340. The holding portions 501 are supported by the support plates 347, In other words, the pair of support plates 347 respectively support the pair of holding portions 501 from the side opposite from the heating roller 340 in the rotational axis direction.

The pair of support plates 347 serving as the holder supporting portion each has a through hole 347*a* formed to penetrate through the support plates 347 in the rotational axis direction. Meanwhile, each holder 345 of the pair of holding portions 501 has a projected portion 345*d* that is protruded in the rotational axis direction and capable of being fitted to the through hole 347*a*. Thus, in a state Where the heater unit 500 is inserted to the heating roller 340 along the rotational axis direction, the through hole 347*a* on one of the support plates 347 receives the projected portion 345*d*.

In the present embodiment, two projected portions 345*d* are provided on the front-side holder 345 and two through holes 347*a* are formed on the front-side support plate 347, as illustrated in FIG. 3A. Meanwhile, one projected portion 345*d* is provide on the rear-side holder 345 and one through hole 347*a* is formed on the rear-side support plate 347, as illustrated in FIG. 3B. To arrange the heater unit 500 in the heating roller 340 according to such structure, at first, the heater unit 500 is inserted from the rear side of the heating roller 340. In this state, the rear-side support plate 347 is not fixed to the frame 301. The two projected portions 345*d* on the front-side holder 345 are each fit to the through hole 347*a* formed on the front-side support plate 347. Thereby, the front side of the heater unit 500 is supported and the circumferential direction of the heater unit 500 is determined. Then, the rear-side support plate 347 is fixed to the frame 301. In this state, one projected portion 345*d* on the rear-side holder 345 is fit to one through hole 347*a*. Thereby, the rear side of the heater unit 500 is also supported.

According to the present embodiment, as described above, the plurality of halogen heaters 341 to 343 is integrated by the pair of holding portions 501 as the heater unit 500 and inserted to the heating roller 340. Thus, the insertion of the plurality of halogen heaters 341 to 343 to the heating roller 340 can be performed easily in a configuration where a plurality of halogen heaters 341 to 343 is arranged on the inner side of the heating roller 340. For example, if the second end side of the heater unit 500 is inserted to the heating roller 340 while holding the first end thereof, the positions and attitudes of the heaters can be controlled easily since the plurality of halogen heaters 341 to 343 is held by the holding portions 501. Thus, it becomes possible to suppress mutual contact of the plurality of halogen heaters 341 to 343 when inserting the halogen heaters 341 to 343. Similarly, mutual contact of the plurality of halogen heaters 341 to 343 can be suppressed during extraction of the halogen heaters 311 to 343 from the heating roller 340.

Other Embodiments

A configuration where a plurality of heaters is arranged in the heating roller 340 across which the fixing belt 310 is stretched has been described according to the above-described embodiment. However, the present invention is not limited to such a belt configuration, and it is also applicable to a configuration where a pair of rollers forms a nip portion and a plurality of heaters is arranged in one of the rollers or in both rollers. It is also applicable to an external heating configuration where the roller is heated from the exterior. For example, one example of an external heating apparatus for heating a heating roller that forms the nip portion from the exterior includes a belt stretched across a plurality of rollers being in contact with the heating roller. In this case, the plurality of heaters must be arranged at least in one roller among the plurality of rollers across which the belt is stretched. The present invention is also applicable to such rollers. Further, the present invention is also applicable to a configuration where the roller is directly in contact with the heating roller without interposing a belt as the external heating apparatus.

According further to the above-described embodiment, a configuration including a halogen heater having three heaters, a halogen heater having two heaters and a halogen heater having one heater was adopted, but the number of heaters according to the present invention is not limited to the above, and a configuration including a halogen heater having two heaters and a halogen heater having one heater can also be adopted.

According to the above-described embodiment, the motor M0 for the pressing roller and the motor M1 for the auxiliary driving roller are provided independently. However the motor for the pressing roller can be commonly used as the motor for the auxiliary driving roller. That is, the pressing roller and the auxiliary driving roller can be driven by a common drive source. In that case, a transmission mechanism is provided between one motor and one of the rollers so that the peripheral speed of the heating roller 340 is set faster than the peripheral speed of the pressing roller 330.

According further to the above-mentioned embodiment, the heating roller 340 is arranged downstream of the fixing pad 320 and upstream of the stretching roller 350 in the direction of rotation of the fixing belt 310. However, the position of the heating roller 340 can be replaced with the position of the stretching roller 350. That is, the heating roller 340 can be arranged downstream of the stretching roller 350 and upstream of the fixing pad 320 in the direction of rotation of the fixing belt 310.

According to the embodiments described above, a configuration where a halogen heater serving as a heater for heating the fixing belt is provided in the auxiliary driving roller has been described. However, the heater can be provided on other stretching members such as a steering roller, instead of the auxiliary driving roller.

According to the embodiments described above, the fixing pad 320 served as the nip portion forming member, but the nip portion forming member can be composed of a roller or other rotators. Further according to the embodiments described above, the pressing roller 330 served as the driving rotator, but the driving rotator can also be a belt that is driven to rotate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-093136, filed May 28, 2020, which is hereby incorporated by reference herein in its entirety.

What is claimed is:

1. An image heating apparatus configured to heat a toner image borne on a recording material at a nip portion, the image heating apparatus comprising:

a heating roller configured to rotate; and a heater unit provided on an inner side of the heating roller, the heater unit configured to be inserted to and extracted from the heating roller along a rotational axis direction of the heating roller;

wherein the heater unit comprises:

a first halogen heater unit comprising a first heating portion, a first glass tube configured to cover the first heating portion, a second heating portion, a second glass tube configured to cover the second heating portion, and a pair of first supporting portions configured to support both end portions of the first glass tube and both end portions of the second glass tube;

a second halogen heater unit comprising a third heating portion, a third glass tube configured to cover the third heating portion, and a pair of second supporting portions configured to support both end portions of the third glass tube; and a pair of holders to which each of the pair of first supporting portions and the pair of second supporting portions are fitted, and which holds the first halogen heater unit and the second halogen heater unit such that the pair of holders, the first halogen heater unit and the second halogen heater unit are integrally inserted to and extracted from the heating roller.

2. The image heating apparatus according to claim 1, further comprising a heating roller supporting portion configured to support the heating roller, and a holder supporting portion provided on the heating roller supporting portion and configured to fit to and support one of the holders.

3. The image heating apparatus according to claim 1, wherein the first halogen heater unit further comprises a fourth heating portion, a fourth glass tube configured to cover the fourth heating portion, and wherein the pair of first supporting portions is configured to support both end portions of the first glass tube, the second glass tube, and the fourth glass tube, wherein the second halogen heater unit further comprises a fifth heating portion and a fifth glass tube configured to cover the fifth heating portion, and wherein the pair of second supporting portions is configured to support both end portions of the third glass tube and the fifth glass tube.

4. The image heating apparatus according to claim 3, wherein the heater unit further comprises a third halogen heater unit comprising a sixth heating portion, a sixth glass tube configured to cover the sixth heating portion, and a pair of third supporting portions configured to support both end portions of the sixth glass tube, wherein the pair of third supporting portions is fitted to the pair of holders, and the pair of holders holds the third halogen heater unit.

5. The image heating apparatus according to claim 1, wherein the heater unit further comprises an annular retaining ring attached to one of the holders and configured to fix one of the first supporting portions and one of the second supporting portions from an outer side.

6. The image heating apparatus according to claim 2, wherein one of the holders comprises a projected portion configured to fit to a through hole provided on the holder supporting portion and position one of the holders to the holder supporting portion.

7. The image heating apparatus according to claim 1, further comprising:

a belt member; and a pressing member configured to press the belt member so as to form the nip portion, wherein the belt member is configured to be stretched across the heating roller.

8. The image heating apparatus according to claim 1, wherein the heating roller comprises a through hole through which the heater unit is inserted and extracted, an inner diameter of the through hole being greater than an outer diameter of one of the holders.

9. The image heating apparatus according to claim 1, wherein the number of glass tubes of the first halogen heater unit is greater than the number of glass tubes of the second halogen heater unit.

10. The image heating apparatus according to claim 1, wherein the holders are made of resin.

11. The image heating apparatus according to claim 4, wherein a center of gravity of one of the holders in a plane when one of the holders is viewed in a rotational axis direction of the heating roller is arranged on an inner side of a shape formed by connecting a center of gravity of each halogen heater unit with a center of gravity of an adjacent halogen heater unit.

* * * * *